US008220183B2

(12) United States Patent
Evans et al.

(10) Patent No.: US 8,220,183 B2
(45) Date of Patent: Jul. 17, 2012

(54) REMOVABLE HEEL PAD FOR FOOT-RECEIVING DEVICE

(75) Inventors: Marty Evans, Amsterdam (NL); Graeme McMillan, Portland, OR (US); Moon Won Kim, Busan (KR)

(73) Assignee: NIKE, Inc., Beaverton, OR (US)

( * ) Notice: Subject to any disclaimer, the term of this patent is extended or adjusted under 35 U.S.C. 154(b) by 644 days.

(21) Appl. No.: 12/359,076

(22) Filed: Jan. 23, 2009

(65) Prior Publication Data

US 2010/0186265 A1 Jul. 29, 2010

(51) Int. Cl.
*A43B 21/42* (2006.01)

(52) U.S. Cl. ..... 36/36 R

(58) Field of Classification Search ..... 36/25 R, 36/37, 28, 29, 30 R, 35 B, 36 R, 31
See application file for complete search history.

(56) References Cited

U.S. PATENT DOCUMENTS

| | | | | |
|---|---|---|---|---|
| 607,086 | A | 7/1898 | Safford | |
| 1,765,849 | A | 6/1930 | Ray | |
| 4,430,810 | A | 2/1984 | Bente | |
| 4,598,487 | A | 7/1986 | Misevich | |
| 4,624,061 | A | 11/1986 | Wezel et al. | |
| 4,843,741 | A | 7/1989 | Yung-Mao | |
| 4,845,863 | A | 7/1989 | Yung-Mao | |
| 4,908,962 | A | 3/1990 | Yung-Mao | |
| 5,077,915 | A * | 1/1992 | Gross | 36/31 |
| 5,086,574 | A | 2/1992 | Bacchiocchi | |
| 5,138,774 | A | 8/1992 | Sarkozi | |
| 5,152,081 | A | 10/1992 | Hallenbeck et al. | |
| 5,174,049 | A | 12/1992 | Flemming | |
| 5,175,946 | A | 1/1993 | Tsai | |
| 5,282,288 | A | 2/1994 | Henson | |
| 5,367,791 | A | 11/1994 | Gross et al. | |
| 5,649,374 | A * | 7/1997 | Chou | 36/27 |
| 5,689,902 | A | 11/1997 | Juang | |
| 5,729,917 | A * | 3/1998 | Slepian et al. | 36/27 |
| 5,775,005 | A | 7/1998 | McClelland | |
| 5,799,417 | A | 9/1998 | Burke et al. | |
| 6,023,859 | A | 2/2000 | Burke et al. | |
| 6,092,311 | A | 7/2000 | MacNamara | |
| RE37,705 | E * | 5/2002 | Donzis | 12/142 R |
| 6,449,878 | B1 | 9/2002 | Lyden | |
| 6,601,042 | B1 | 7/2003 | Lyden | |
| 6,691,432 | B2 | 2/2004 | Masseron | |
| 6,807,753 | B2 | 10/2004 | Steszyn et al. | |
| 7,000,334 | B2 | 2/2006 | Gillespie | |
| 7,000,335 | B2 | 2/2006 | Swigart et al. | |
| 7,016,867 | B2 | 3/2006 | Lyden | |
| 7,076,890 | B2 | 7/2006 | Grove et al. | |
| 7,107,235 | B2 | 9/2006 | Lyden | |

(Continued)

FOREIGN PATENT DOCUMENTS

| | | | |
|---|---|---|---|
| EP | 0111084 | A1 | 6/1984 |

(Continued)

*Primary Examiner* — Milton Nelson, Jr.
(74) *Attorney, Agent, or Firm* — Banner & Witcoff, Ltd.

(57) ABSTRACT

Foot-receiving devices, such as articles of footwear (e.g., athletic footwear, etc.), include a foot-covering member (such as an upper member) and a foot-supporting member (such as a sole member, optionally including insole, midsole, and/or outsole portions) engaged with the foot-covering member. The foot-supporting member may include or define a cavity or void in the heel portion of the foot-receiving device. The foot-receiving device further may include a removable heel pad detachably engaged within the cavity or void.

25 Claims, 4 Drawing Sheets

U.S. PATENT DOCUMENTS

| | | | | |
|---|---|---|---|---|
| 7,114,269 | B2 | 10/2006 | Meschan | |
| 7,168,188 | B2 * | 1/2007 | Auger et al. | 36/69 |
| 7,213,354 | B1 | 5/2007 | Byrd et al. | |
| 7,228,648 | B2 | 6/2007 | Yang | |
| 2002/0050077 | A1 | 5/2002 | Wang et al. | |
| 2004/0068892 | A1 * | 4/2004 | Wang | 36/28 |
| 2004/0194344 | A1 | 10/2004 | Tadin | |
| 2005/0011085 | A1 * | 1/2005 | Swigart et al. | 36/31 |
| 2005/0160626 | A1 | 7/2005 | Townsend | |
| 2006/0053656 | A1 | 3/2006 | Kumle | |
| 2006/0130364 | A1 | 6/2006 | Greene et al. | |
| 2006/0218819 | A1 | 10/2006 | Wu | |
| 2006/0283044 | A1 | 12/2006 | Lacey | |
| 2007/0113425 | A1 | 5/2007 | Wakley et al. | |
| 2007/0204484 | A1 | 9/2007 | Davis | |
| 2011/0162232 | A1 * | 7/2011 | Gazzara et al. | 36/29 |

FOREIGN PATENT DOCUMENTS

| | | | |
|---|---|---|---|
| EP | 0388661 | A1 | 9/1990 |
| GB | 2263619 | A | 4/1993 |
| JP | 02082901 | A | 3/1990 |
| JP | 05003801 | A | 1/1993 |
| JP | 08000303 | A | 1/1996 |
| WO | 9115973 | A1 | 10/1991 |

* cited by examiner

REMOVABLE HEEL PAD FOR FOOT-RECEIVING DEVICE

FIELD OF THE INVENTION

This invention relates generally to articles of footwear or other foot-receiving devices that include removable heel pads to adjust one or more characteristic of the article of footwear, such as a performance characteristic of the article of footwear, based on a characteristic of the heel pads.

BACKGROUND

Conventional articles of footwear have included two primary elements, namely an upper member and a sole structure. The upper member provides a covering for the foot that receives and positions the foot with respect to the sole structure. In addition, the upper member may have a configuration that protects the foot and provides ventilation, thereby cooling the foot and removing perspiration. The sole structure generally is secured to a lower portion of the upper member and generally is positioned between the foot and the contact surface (the terms "contact surface" or "surface," as used herein, include any foot or footwear contact surface, including but not limited to: grass, dirt, snow, ice, tile, flooring, carpeting, synthetic grass, asphalt, concrete, clay, court surfaces, and the like). In addition to attenuating ground reaction forces, the sole structure may provide traction and help control foot motion, such as pronation. Accordingly, the upper member and the sole structure operate cooperatively to provide a comfortable structure that is suited for a variety of ambulatory activities, such as walking and running.

The sole member of athletic footwear, in at least some instances, will exhibit a layered configuration that includes a comfort-enhancing insole, a resilient midsole (e.g., formed, at least in part, from a polymer foam material), and a ground-contacting outsole that provides both abrasion-resistance and traction. The midsole, in at least some instances, will be the primary sole structure element that attenuates ground reaction forces and controls foot motion. Suitable polymer foam materials for at least portions of the midsole include ethylvinylacetate ("EVA") or polyurethane ("PU") that compress resiliently under an applied load to attenuate ground reaction forces. Conventional polymer foam materials are resiliently compressible, in part, due to the inclusion of a plurality of open or closed cells that define an inner volume substantially displaced by gas. The upper member and sole structure in conventional footwear products may be joined to one another in various different ways, such as using cements or adhesives, stitching or sewing, mechanical connectors, fusing techniques, or the like.

SUMMARY

The following presents a general summary of aspects of this invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to foot-receiving devices, such as articles of footwear (e.g., athletic footwear, etc.), that include a foot-covering member (such as an upper member) and a foot-supporting member (such as a sole member, optionally including insole, midsole, and/or outsole portions) engaged with the foot-covering member. The foot-supporting member may include or define a cavity or void in the heel portion of the foot-receiving device. The foot-receiving device further may include a removable heel pad to detachably engage the cavity or void.

Additional aspects of this invention relate to example methods for providing and methods of using footwear or foot-receiving device systems of the types described above. Such methods may include providing articles of footwear (e.g., athletic footwear, etc.) that include a foot-covering member (such as an upper member) and a foot-supporting member of the types described above (such as a sole member, optionally including insole, midsole, and/or outsole portions) engaged with the foot-covering member. The methods further may include providing a foot-supporting member that includes or defines a cavity in the heel portion of the foot-receiving device and/or providing a removable heel pad to detachably engage the cavity.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

Figure 1:
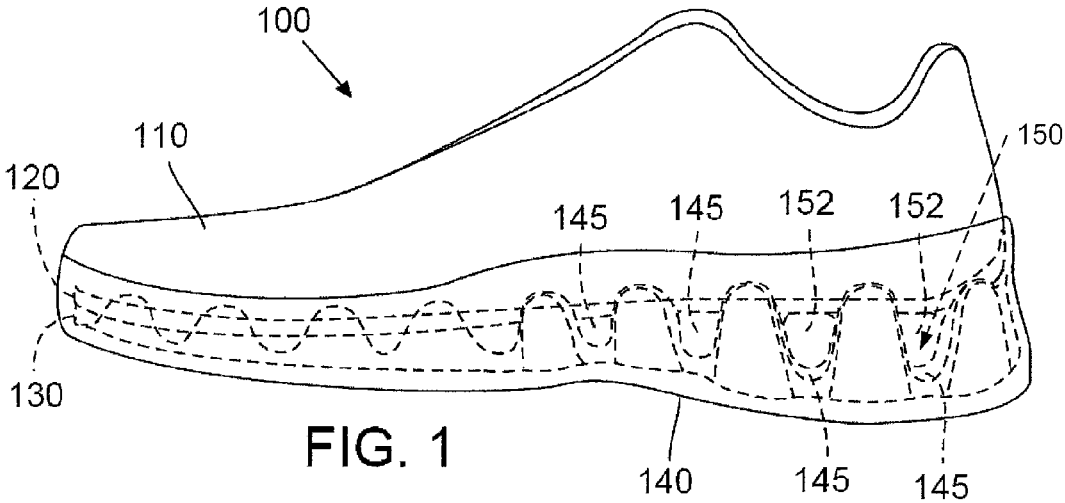
FIG. 1 illustrates an overview of an example system according to an embodiment of the invention.

In the following description of various examples of the invention, reference is made to the accompanying drawings, which form a part hereof, and in which are shown by way of illustration various example systems and environments in which aspects of the invention may be practiced. It is to be understood that other specific arrangements of parts, example systems, and environments may be utilized and structural and functional modifications may be made without departing from the scope of the present invention. Also, while the terms "top," "bottom," "side," "front," "back," "above," "below," "under," "over," and the like may be used in this specification to describe various example features and elements of the invention, these terms are used herein as a matter of convenience, e.g., based on the example orientations shown in the figures and/or a typical orientation during use. Nothing in this specification should be construed as requiring a specific three dimensional orientation of structures in order to fall within the scope of this invention.

To assist the reader, this specification is broken into various subsections, as follows: Terms; General Description of Foot-Receiving Devices including Removable Heel Inserts and Methods of Providing and Using Them According to the Invention; and Specific Examples of the Invention.

A. Terms

The following terms are used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of product worn on the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, etc.), and the like. "Footwear" may protect the feet from the environment and/or enhance a wearer's performance (e.g., physically, physiologically, medically, etc.).

"Foot-covering members" include one or more portions of a foot-receiving device that extend at least partially over and/or at least partially cover at least some portion of the wearer's foot, e.g., so as to assist in holding the foot-receiving device on and/or in place with respect to the wearer's foot. "Foot-covering members" include, but are not limited to, upper members of the type provided in some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down in the foot-receiving device. "Foot-supporting members" include, but are not limited to, sole members of the type provided in some conventional footwear products. Such sole members may include conventional outsole, midsole, and/or insole members.

"Ground-contacting elements" or "members" include at least some portions of a foot-receiving device structure that contact the ground or any other surface in use, and/or at least some portions of a foot-receiving device structure that engage another element or structure in use. Such "ground-contacting elements" may include, for example, but are not limited to, outsole elements provided in some conventional footwear products. "Ground-contacting elements" in at least some example structures may be made of suitable and conventional materials to provide long wear, traction, and protect the foot and/or to prevent the remainder of the foot-receiving device structure from wear effects, e.g., when contacting the ground or other surface in use.

The term "lateral," when used alone herein, generically refers to any side area or side surface of something. When intended to refer specifically to an outside portion of a foot, a shoe, or a portion of an article of footwear, the term "lateral side" is used (the "lateral side" is located opposite the "medial side" or inside of the foot, shoe, or portion of the article of footwear).

B. General Description of Foot-Receiving Devices Including Removable Heel Inserts and Methods of Providing and Using them According to the Invention Some aspects of the present invention relate generally to footwear and other foot-receiving devices. As shown in FIG. 1, which generally illustrates an example of the invention and an example environment in which the invention may be used, one or more individual articles of footwear 100 (such as athletic footwear or other foot-receiving devices) may be equipped with one or more removable heel pads. The removable heel pads may occupy one or more cavities or voids located substantially in and/or defined by the heel portion of the foot supporting member of the articles of footwear 100.

The removable heel pad or pads may be formed from a variety of materials or have a variety of characteristics. As numerous removable heel pads with distinct characteristics are interchangeable, at least a portion of the foot supporting member may be tuned or adjusted based on the selection of a particular heel pad. A single footwear device may accordingly exhibit differing characteristics based on the particular heel pad removably inserted therein. Further, heel pads that become worn or whose characteristics (e.g., fit, stiffness, impact force attenuation, resiliency, and the like) decline by use or exposure may be replaced with the same or substantially similar heel pad to restore the footwear device to an earlier condition.

In light of this general example and general description of an example environment of use, various example aspects of the invention will be described in more detail below, including various example features relating to example structural components of foot-receiving devices including removable heel pads in accordance with the invention and manners of providing and using such systems.

1. Example Foot-Receiving Devices Including Removable Heel Pads According to the Invention In general, aspects of this invention relate to foot-receiving devices including one or more removable heel pads. The foot-receiving devices may include articles of footwear (e.g., athletic footwear, etc.) that include a foot-covering member (such as an upper member) and a foot-supporting member (such as a sole member, optionally including an insole, a midsole, and/or an outsole member) engaged with the foot-covering member. The foot-receiving device further may include or define one or more cavities or voids in the foot-supporting member substantially in the heel area to accommodate a removable heel pad. Alternatively, the absence of at least a portion of the midsole member substantially in the heel area of the foot-receiving device may define a cavity or void to accommodate the removable heel pad of an embodiment. If desired, an insole member may at least partially, substantially, or completely cover the midsole member including the heel pad.

The removable heel pad of an example embodiment of this invention may occupy all or substantially all of the entire heel region of the foot-receiving device when removably inserted therein (e.g., at least 60%, at least 75%, or even at least 85% of the heel region area). Additionally, the heel pad may include one or more protrusions extending therefrom. When inserted in the cavity or void formed in or defined by the midsole member, the protrusions may extend laterally and/or downwardly (i.e., toward the bottom of the foot-receiving device) into at least a portion of the outsole member and/or into at least a portion of the midsole member, as will be described more fully below. The heel pad may further include a loop or tab that may be used to pull the heel pad from the cavity or void in the midsole member to remove it therefrom.

As noted, the one or more protrusions included in the removable heel pad of an example embodiment of this invention may extend laterally and/or downwardly into the outsole member and/or into the midsole member. More specifically, the ground-contacting member (e.g., an outsole member) and/or the midsole member may include one or more laterally and/or downwardly oriented apertures or recesses into which the removable heel pad protrusions may extend to detachably secure the removable heel pad in the cavity or void formed in or defined by the midsole member. If desired, the apertures in the ground-contacting member, outsole member, and/or midsole member may extend completely through the member such that the removable heel pad protrusions may be visible from the exterior of the foot-receiving device. As noted, the ground-contacting member, outsole member, and/or midsole member may include one or more apertures extending laterally (i.e., approximately from the side of a heel if inserted therein) and one or more apertures extending downwardly in part or fully through the base or bottom of the ground-contacting member, outsole member, and/or midsole member.

The removable heel pad may be formed of a variety of materials and/or include a variety of features or elements to alter or adjust characteristics of the foot-receiving device. For example, the removable heel pad may be formed of a variety of materials and/or include a variety of features to generate various impact attenuation properties of the foot-receiving device. The removable heel pad may further be formed of a variety of materials and/or include a variety of features to increase rebound properties. The selection of one or more materials and/or one or more features or elements allow the removable heel pad to adjust one or more performance characteristics of the foot-receiving device.

2. Example Methods of Providing and Using Foot-Receiving Device Systems According to Examples of the Invention Still additional aspects of this invention include methods of providing and methods of using footwear or other foot-receiving device systems that include removable heel pads, e.g., of the types described above.

For example, to insert a removable heel pad into the foot-receiving device, at least a portion of the insole member, if present, may be removed or lifted away from the midsole member to expose the cavity or void in the heel region of the midsole member in which the removable heel pad will be inserted. The removable heel pad then may be inserted into the midsole cavity or void. One or more protrusions extending from the removable heel pad may detachably engage one or more apertures formed in the outsole member and/or midsole member to substantially secure the removable heel pad in the cavity or void formed in or at least partially defined by the midsole member. The portion of the insole member that had been removed or lifted (if any) from the midsole member then may be replaced so that the insole member at least partially, substantially, or completely covers or encloses the removable heel pad. Accordingly, when worn, the foot-receiving device including the removable heel pad may not present a wearer with an abnormal feeling of fit, comfort, or the like. Optionally, if desired, an insole member may be engaged with or integrally formed with the removable heel pad such that the insole member and the heel pad are inserted and removed simultaneously.

To remove or withdraw the removable heel pad from the foot-receiving device, at least a portion of the insole member (if present) may be removed or lifted away from the midsole member to expose one or more cavities or voids formed in or defined by the heel region of the midsole member containing the removable heel pad. The removable heel pad may then be withdrawn from the cavity or void. In at least some example embodiments, the removable heel pad may include a strap, loop, or other similar extension that may be gripped to facilitate the withdrawal. The protrusions extending from the removable heel pad then may disengage the apertures formed in the outsole member and/or the midsole member and the removable heel pad may be pulled and withdrawn from the cavity or void in the midsole member. If desired, the portion of the insole member that had been removed or lifted from the midsole member (if any) then may be replaced so that the insole member at least partially, substantially, or completely covers or encloses the cavity or void formed in the midsole member. Alternatively, another removable heel pad may be inserted according to the description above before the portion of the insole member is replaced.

Specific examples of structures according to examples of the invention are described in more detail below. The reader should understand that these specific examples and structures are set forth merely to illustrate the invention, and they should not be construed as limiting the invention.

C. Specific Examples of the Invention

The various figures in this application illustrate examples of footwear and other foot-receiving device products according to examples of this invention. When the same reference number appears in more than one drawing, that reference number is used consistently in this specification and the drawings to refer to the same or similar parts throughout.

As described above, FIG. 1 generally illustrates an example of the invention in which an article or articles of footwear 100 (e.g., athletic footwear, etc.) or other foot-receiving devices are equipped with one or more removable heel pads 150. The article of footwear 100 may include an upper member 110, an insole member 120, a midsole member 130, and an outsole member 140. In some example footwear structures 100 according to this invention, at least the midsole member 130 and/or the outsole member 140 are engaged with the upper member 110.

The outsole member 140 and/or the midsole member 130 may include one or more lateral apertures 145. At least a portion of these lateral apertures 145 may be occupied by or filled with one or more protrusions extending from or included as part of the midsole member 130. For example, if desired, at least the lateral apertures 145 adjacent to a forward area of the arch portion of the article of footwear 100 (i.e., the portion of the article of footwear 100 adjacent to the arch portion of the foot when the foot is inserted therein) may be occupied by or filled with protrusions extending from or included as part of the midsole member 130. In such structures, the remaining lateral apertures 145 need not be occupied by or filled with protrusions extending from or included as part of the midsole member 130. Rather, as will be explained more fully in conjunction with FIG. 2, the outsole member 140 (or midsole member 130) lateral apertures 145 in the heel region of the article of footwear 100 are available to receive lateral protrusions 152 extending from the removable heel pad 150 when it is inserted into the heel portion of the article of footwear 100.

Figure 2:
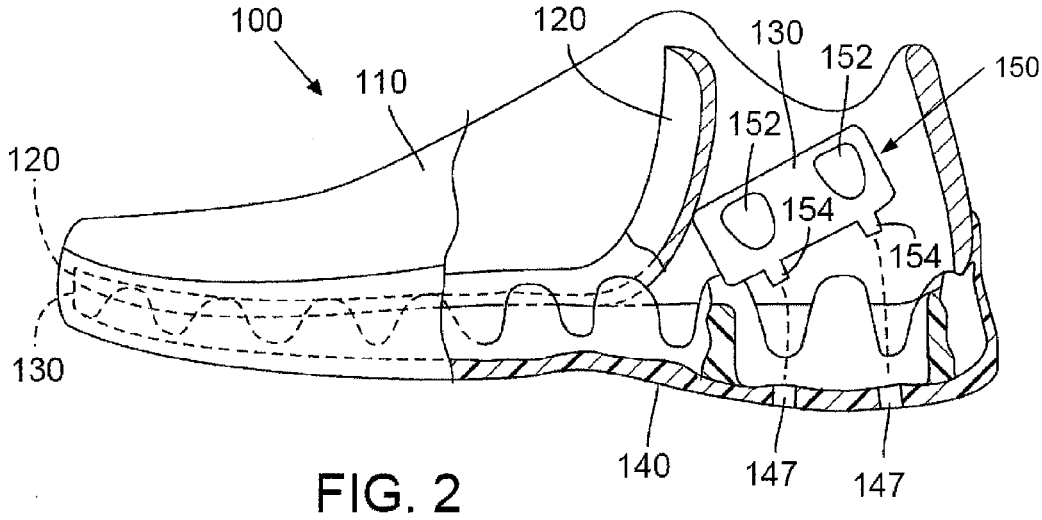
FIG. 2 illustrates an example of an article of footwear including a cavity for the insertion of a removable heel pad in accordance with embodiments of the invention.

More specifically, FIG. 2 schematically illustrates a partial sectional view of an example of an article of footwear 100 including a cavity for the insertion of the removable heel pad 150 in accordance with at least some examples of the invention. As illustrated, a portion of the insole member 120 is folded back or otherwise removed from the heel region of the article of footwear 100 to reveal one or more cavities or voids formed in or defined by the midsole member 130. Alternatively, the midsole member 130 may not extend fully into the heel portion of the article of footwear 100 to form the cavity or void as a gap between the insole member 120 and the outsole member 140 in that region.

The removable heel pad 150, here shown partially inserted into or removed from the article of footwear 100, contains a plurality of protrusions 152 extending therefrom. For example, the removable heel pad 150 may include one or more lateral protrusions 152 extending laterally (i.e., outwardly from the sides of) from the removable heel pad 150. The removable heel pad 150 may further include one or more bottom protrusions 154 (i.e., extending in the downward direction relative to a foot inserted in the article of footwear 100, or toward the bottom of the outsole member 140). When the removable heel pad 150 is inserted into the heel portion of the article of footwear 100, the lateral protrusions 152 may engage the lateral apertures 145 (or recesses) in the outsole member 140 and/or the midsole member 130. Further, the bottom protrusions 154 may engage bottom apertures 147 (or recesses) in the outsole member 140 and/or the midsole member 130. In at least some example structures in accordance with this invention, the lateral apertures 145 and/or the bottom apertures 147 may extend completely through the outsole member 140 and/or the midsole member 130. Accordingly, the lateral protrusions 152 and/or the bottom protrusions 154 further may provide an externally visible visual indication of whether or not a removable heel pad 150 is inserted in the article of footwear 100 (in particular, if the lateral protrusions 152 and/or bottom protrusions 154 differ in, for example, color, texture, pattern, or the like, as compared with the outsole member 140 and/or the midsole member 130 located adjacent to the lateral apertures 145 and/or the bottom apertures 147. Optionally, if desired, the removable heel pads 150 may be color, pattern, and/or texture coded to indicate one or more properties of the heel pad, such as its stiffness, rebound characteristics, etc. In such instances, the externally available visual indication (if any) may provide information regarding the type of heel pad 150 inserted therein.

Figure 3:
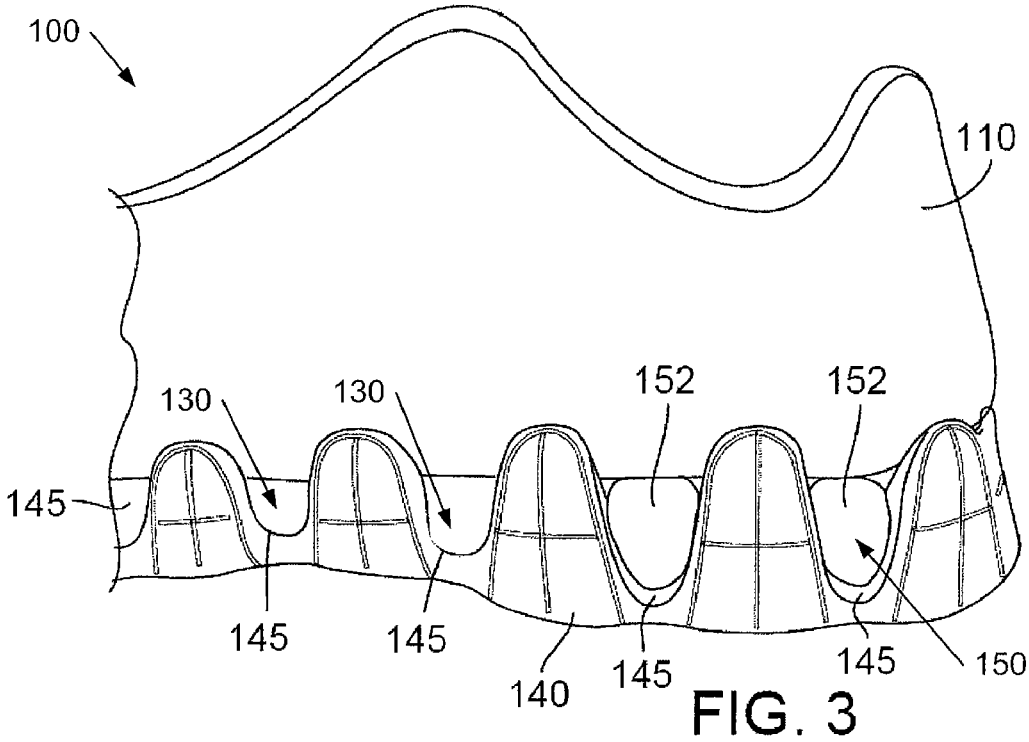
FIG. 3 illustrates an example of an article of footwear including a removable heel pad inserted therein and extending through sole member lateral apertures in accordance with examples of the invention.

FIG. 3 illustrates the heel portion of an article of footwear 100 with a removable heel pad 150 of an example of this invention removably inserted therein. As noted, the outsole member 140 (or the midsole member 130) may define one or more lateral apertures 145 through which one or more portions of the midsole member 130 and/or the removable heel pad 150 may protrude. For example, the removable heel pad 150 lateral protrusions 152 may extend partially or substantially through the apertures 145 in the heel region of the article of footwear 100. The remaining apertures 145, if any (e.g., those not substantially in the heel region of the article of footwear 100), may contain or be substantially occluded by protrusions extending from the midsole member 130. Alternatively, if desired, the midsole 130 and/or removable heel pad 150 simply may be visible through the apertures 145 (e.g., without protrusions extending into or through these apertures 145).

Figure 4:
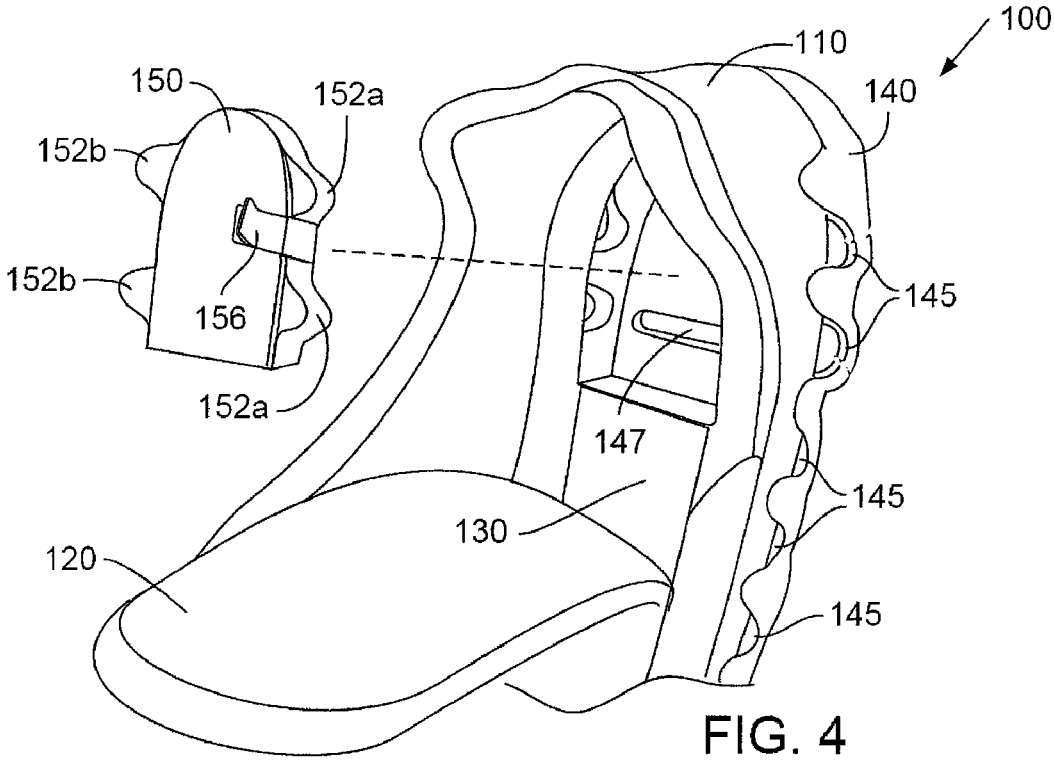
FIG. 4 illustrates an example of an article of footwear including a cavity for the insertion of a removable heel pad in accordance with examples of the invention.

FIG. 4 schematically illustrates the interior of the heel portion of an article of footwear 100 into which a removable heel pad 150 may be inserted. At least the heel portion of the midsole member 130 may form or define a cavity or void, or otherwise be absent. For example, as illustrated in this example structure 100, the midsole member 130 does not extend into the heel portion of the article of footwear 100, and the cavity or void into which the removable heel pad 150 may be inserted is a gap between the insole member 120 and the outsole member 140 as further defined laterally by the upper member 110 and/or side surfaces of the outsole member 140 and/or midsole member 130.

FIG. 4 also illustrates that one or more lateral apertures 145 and/or one or more bottom apertures 147 may be formed in the outsole member 140 (and/or the midsole member 130). In an embodiment, the one or more lateral apertures 145 and/or one or more bottom apertures 147 may be formed substantially in the heel portion of the article of footwear 100. As noted, in an embodiment, one or more lateral protrusions 152 extending from the removable heel pad 150 may detachably engage the one or more lateral apertures 145. Further, one or more bottom protrusions 154 on the heel pad 150 may detachably engage the one or more bottom apertures 147.

FIG. 4 further illustrates that the removable heel pad 150 may include a strap member 156 that may be grasped to pull the removable heel pad 150 from an article of footwear 100 into which it has been removably inserted. The strap member 156 in accordance with at least some examples of this invention may include a loop or other "handle-type member" to facilitate the grasping. The strap member 156 may extend from one lateral side of the removable heel pad 150 so that it does not substantially interfere with or underlie a foot inserted in the article of footwear 100. In an embodiment, the insole member 120 may further shield the foot from direct contact with the strap member 156. The strap member 156, and its operation to withdraw the removable heel pad 150 from an article of footwear 100 into which it has been removably inserted will be described more fully below.

Also illustrated by FIG. 4 is that the lateral protrusions 152 of heel pad 150 need not have the same configuration, for example, depending on from which lateral side they protrude. For example, the medial side protrusions 152*a* may have a different shape or configuration than the lateral side protrusions 152*b*. In this context, "medial side" refers to the inside of the article of footwear 100 and "lateral side" refers to the outside of the article of footwear 100. In some example structures, the one or more medial side protrusions 152*a* adjacent to the strap member 156 may protrude less significantly from a main body the removable heel pad 150 than the one or more lateral side protrusions 152*b*. In that manner, the medial side protrusions 152*a* adjacent to the strap member 156 may not substantially bind the removable heel pad 150 to the respective lateral apertures 145 in the outsole member 140 when the strap member 156 is grasped and pulled. For example, in some example structures, the strap member 156 may extend from the medial side of the removable heel pad 150. For such an arrangement, the medial side protrusions 152*a* may be shorter than, or extend into the outsole member 140 (and/or midsole member 130) lateral apertures 145 less than, the lateral side protrusions 152*b*. In an alternate embodiment, the strap member 156 may extend from the lateral side (outside) of the removable heel pad 150. For such an embodiment, the lateral side protrusions 152*b* may be shorter than, or extend into the outsole member 140 (and/or midsole member 130) lateral apertures 145 less than, the medial side protrusions 152*a*. In yet another embodiment (not illustrated) the strap member 156 may extend from the rear heel side of the removable heel pad 150. For such an embodiment, the rear-most lateral protrusions (not labeled) may be shorter than, or extend into the outsole member 140 (and/or midsole 130) lateral apertures 145 less than the forward-most lateral protrusions (not labeled). The lateral protrusions 152 and the lateral apertures 145 can help hold the heel pad 150 in place with respect to the remainder of the footwear structure 100.

Figure 5:
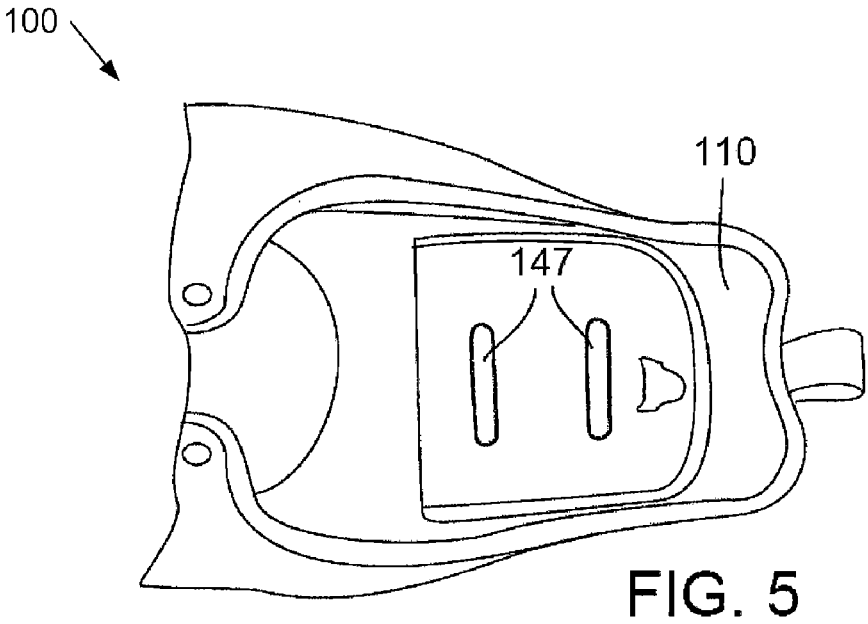
FIG. 5 illustrates an example of an article of footwear including a cavity and apertures in the base of an outsole member in accordance with examples of the invention.

FIG. 5 illustrates an example of an article of footwear 100 including a cavity or void for the insertion of the removable heel pad 150. As noted, in at least some example structures, the cavity or void may be formed in or defined by the midsole member 130 in the heel portion of the article of footwear 100. Alternatively, the cavity or void may be formed in or defined by the absence of the midsole member 130 in the heel portion of the article of footwear 100 whereby the cavity may be a gap between the insole member 120 and the outsole member 140. In an embodiment, the outsole member 140 adjacent to the cavity (or the midsole member 130 at this location) may include one or more bottom apertures 147. The bottom apertures 147 may extend completely through the outsole member 140. In an embodiment, the bottom apertures 147 may have an approximately oblong shape and may extend laterally across the heel portion of the outsole member 140 (and/or the midsole member 130). Embodiments are not limited in this context.

Figure 6:
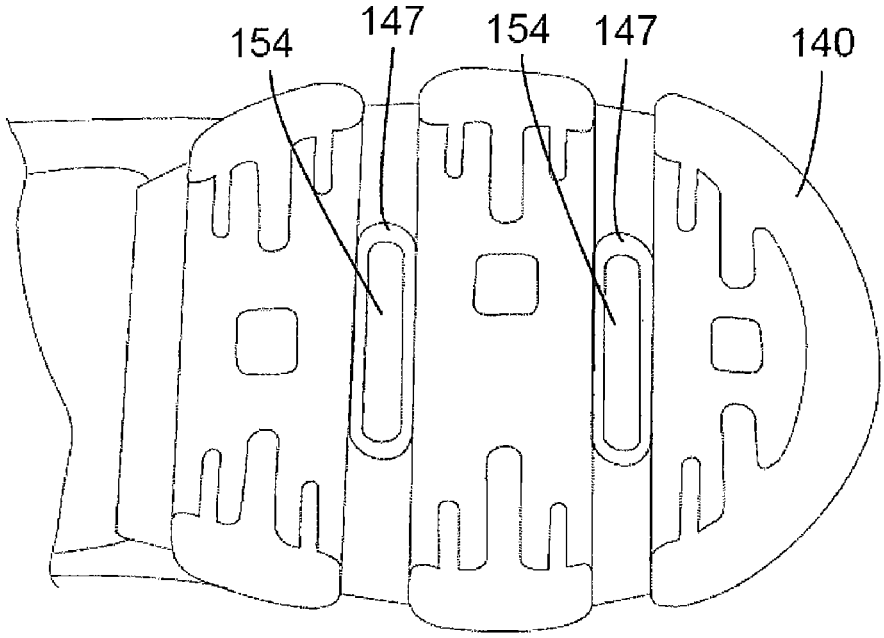
FIG. 6 illustrates an example of an outsole member for an article of footwear that includes apertures in accordance with examples of the invention.

FIG. 6 illustrates an example of an outsole member 140 for the article of footwear 100 of FIG. 5 that includes bottom apertures 147 in accordance with examples of the invention. More specifically, FIG. 6 illustrates a bottom view of the article of footwear 100 when a removable heel pad 150 has been removably inserted therein. One or more bottom protrusions 154 of the removable heel pad 150 may extend into the bottom apertures 147 of the outsole member 140 and/or the midsole member 130. In an embodiment, the one or more bottom protrusions 154 of the removable heel pad 150 may extend completely through the bottom apertures 147 of the outsole member 140 (and/or the midsole member 130). These bottom protrusions 154 and bottom apertures 147 can help hold the heel pad 150 in place with respect to the remainder of the footwear structure 100.

Figure 7:
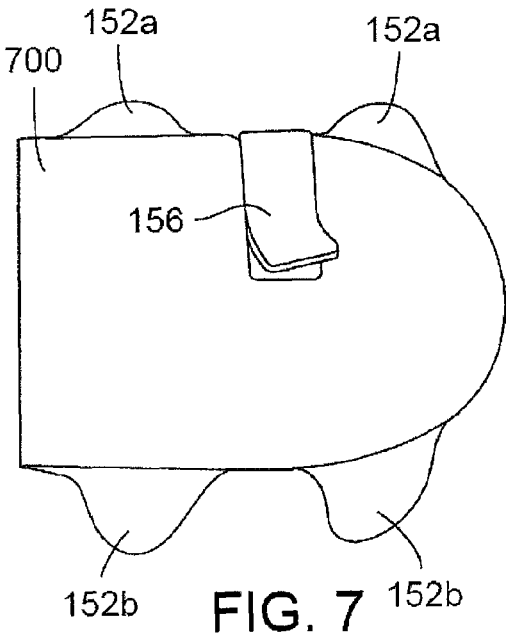
FIG. 7 illustrates an example of a removable heel pad in accordance with examples of the invention.

FIGS. 7-10 illustrate various embodiments of removable heel pads including various impact force attenuating elements and configurations. Generally, the various impact force attenuating elements and configurations may alter one or more performance characteristics of the article of footwear 100 into which the removable heel pad is inserted. Each removable heel pad embodiment will be described in turn. FIG. 7 illustrates the top view of removable heel pad 700 of an embodiment. As described above the strap member 156 may be located on the medial side of the removable heel pad 700 (i.e., removable heel pad 700 may fit into an article of footwear 100 configured for a left foot). Further, the medial side protrusions 152*a* may be shorter than, or extend into the outsole member 140 (and/or midsole member 130) lateral apertures 145 less than, the lateral side protrusions 152*b*. Removable heel pad 700 may be formed from a variety of rubber, foam, or other elastomeric materials. For example, the heel pad 700 may be made from polyurethane foam, ethylvinyl acetate (EVA) materials, or other materials conventionally used in midsole members, such as midsole 130. In an embodiment, the removable heel pad 700 may be formed substantially completely from the same material. Alternatively, the removable heel pad 700 may be formed from a combination of two or more materials. For example, a portion of the removable heel pad 700 may be formed from a material with a first impact force attenuating property and/or rebound property while another portion of the removable heel pad 700 may be formed from a material with a second impact force attenuating property and/or rebound property. The selection of one or more materials for the removable heel pad 700 may alter one or more performance characteristics of the article of footwear 100 into which the removable heel pad 700 is inserted. The embodiments are not limited in this context.

Figure 8:
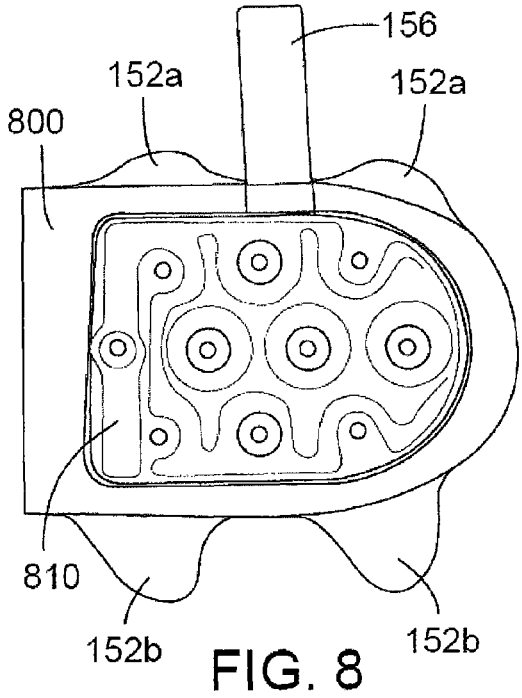
FIG. 8 illustrates another example of a removable heel pad in accordance with examples of the invention.

FIG. 8 illustrates removable heel pad 800 of an embodiment including an impact force attenuating element. In this example structure, the impact force attenuating element may include a fluid-filled bladder member 810. In general, the bladder member 810 may include a sealed membrane or the like attached to or included within the removable heel pad 800. The bladder member 810 of an embodiment may be single bladder sealed around its circumference or it may have multiple chambers or internal attachment points to adjust the impact force attenuation properties and/or shape of the removable heel pad 800. Further, the bladder member 810 may be filled with a gas, liquid, gel, polymer, and the like, including conventional materials used for bladder members in footwear structures as are known and used in the art. In an embodiment, bladder member 810 may be filled with air. If desired, the entire heel pad 800 may be constructed as a bladder member. Alternatively, if desired, only a portion of the heel pad 800 may be formed from the bladder member 810, as illustrated in FIG. 8 (the remainder of the heel pad 800 may be formed from conventional midsole materials, e.g., as described above in conjunction with FIG. 7).

Figure 9:
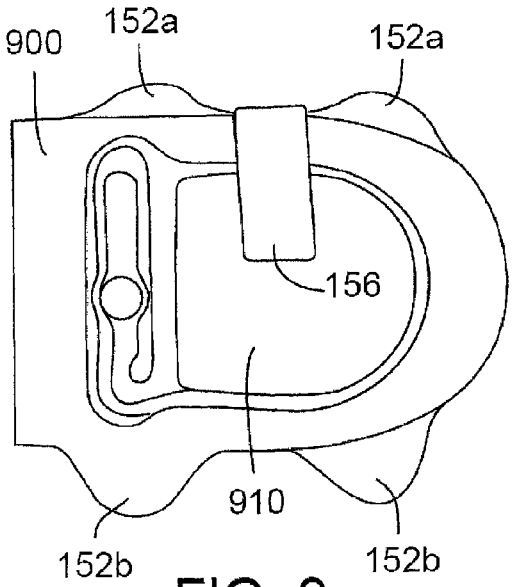
FIG. 9 illustrates another example of a removable heel pad in accordance with examples of the invention.

FIG. 9 illustrates removable heel pad 900 of an embodiment including an alternate bladder member 910. Like bladder member 810, bladder member 910 may include a sealed membrane or the like attached to or included within the removable heel pad 900. The bladder member 910 of this example structure 900 may be single bladder sealed around its circumference or it may have multiple chambers or internal attachment points to adjust the impact force attenuation properties and/or shape. Further, the bladder member 910 may be filled with a gas, liquid, gel, polymer, and the like including conventional materials used for bladder members in footwear structures as are known and used in the art. Bladder member 910 may further include an additional impact force attenuating element within the bladder member 910 chamber. For example the additional rebound attenuating element within the bladder member 910 chamber may be a gel, polymer, foam, fabric, or the like that may occupy at least a portion of the bladder member 910 chamber to further alter the impact force attenuating property of the removable heel pad 900. As another example, if desired, the bladder member 910 may include a fabric or other element therein that aids in forming and/or maintaining the fluid-filled bladder in a predetermined and desired shape, as is known in the art.

Figure 10:
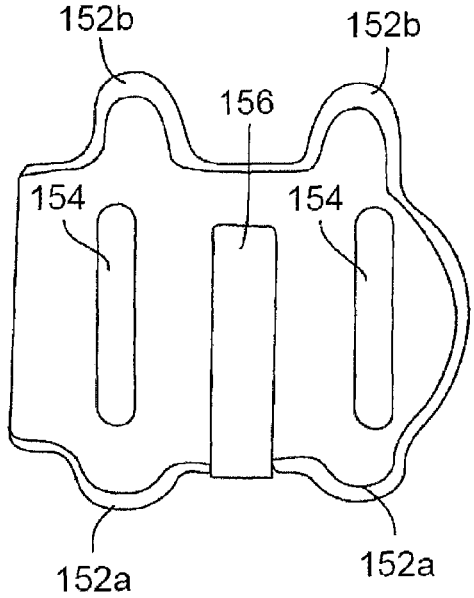
FIG. 10 illustrates the bottom of removable heel pads, such as those shown in FIGS. 7-9, including protrusions to extend into apertures included in the base of the outsole member.

FIG. 10 illustrates the bottom side of removable heel pads according to at least some examples of this invention, e.g., the removable heel pads 150, 700, 800, and 900. As described above with reference to FIGS. 2 and 6, the removable heel pads of various embodiments include one or more bottom protrusions 154 to engage bottom apertures 147 formed in the outsole member 140 and/or the midsole member 130. Further illustrated is that the origin of the strap member 156 may extend or wrap around the bottom side and/or anchor within the bottom side of the removable heel pads 150, 700, 800, and 900 to increase the attachment strength of the strap member 156 and to provide leverage for pulling the heel pads out of the cavities or voids. The strap member 156 or other handle portion may be engaged with the heel pad 150, 700, 800, or 900 in any desired manner without departing from this invention, including through the use of cements or adhesives, by stitching or sewing, by mechanical connectors, etc. As another example, if desired, the strap member 156 or other handle portion may be integrally formed as part of the heel pad 150, 700, 800, or 900, e.g., through molding or other material forming techniques, etc.

Various examples of the invention described above relate to a single removable heel pad located in a single cavity or void. Other configurations are possible in accordance with examples of the invention. For example, multiple removable heel pads may occupy a single cavity or void. Further, a single removable heel pad may bridge or span one or more cavities or voids. Further still, the one or more cavities or voids and the removable heel pads for insertion may be located in one or more regions of the article of footwear, for example in regions in lieu of, or in addition to, the heel region. For example, an alternate or additional region may be adjacent to the ball of the foot.

Various examples of the invention described above relate to use of removable heel pads in accordance with examples of the invention to adjust various characteristics of an article of footwear (or other foot-receiving device). While this description describes various advantageous aspects in accordance with some examples of this invention, the invention is not limited to use in these situations. For example, systems and methods according to at least some examples of the invention may be used to adjust characteristics of an article of footwear (or other foot-receiving device) over time and/or under different use conditions, e.g., to accommodate for changes in the footwear structure and impact force attenuation or other performance characteristic caused by wear, damage, aging, temperature, humidity, moisture, athletic application, conditions of play, etc. As a more specific example, aspects of the present invention may be used to adapt the impact attenuation characteristics of an article of footwear due to changes in the foam material of the midsole member that may occur over time (e.g., due to foam breakdown, damage, wetness, aging, etc.), so that the article of footwear provides a more consistent feel throughout its life and/or under a wide variety of use conditions.

Various different methods of providing footwear systems including removable heel pads also may be provided without departing from the invention, as is evident from the description above. Such methods may include detachably engaging a removable heel pad with an article of footwear, e.g., with the upper member and/or sole member, etc. This engaging may occur during footwear manufacture or assembly, at retail or use locations (e.g., the article of footwear may be provided with one or more removable heel pads that may be removably installed at the time of purchase or thereafter, etc.), by the user at home or at an event venue, etc. Further, additional or replacement removable heel pads may be provided with the article of footwear or may be provided separately. The additional or replacement removable heel pads may have any variety of impact force attenuation and/or foam rebound properties or elements as introduced above with respect to FIGS. 7-10. Accordingly, the impact force attenuation properties, foam rebound properties, or other performance characteristics of the article of footwear may be adjusted, altered, or restored by the substitution or replacement of one set of removable heel pads with another.

CONCLUSION

Of course, many modifications to the specifically described structures, systems, and methods may take place without departing from this invention. For example, while the invention has been described with respect to specific examples including presently preferred modes of carrying out the invention, those skilled in the art will appreciate that there are numerous variations, combinations, and permutations of the above described systems and methods. Moreover, various specific structural features included in the examples merely represent examples of structural features that may be included in some examples of structures according to the invention. Those skilled in the art will understand that various specific structural features may be omitted and/or modified in a footwear or other foot-receiving device product without departing from the invention. Moreover, with respect to the methods, many variations in the method steps may take place, the steps may be changed in order, various steps or features may be added or omitted, etc., without departing from the invention. Thus, the reader should understand that the spirit and scope of the invention should be construed broadly as set forth in the appended claims.

We claim:

1. A footwear system, comprising:

an article of footwear including an upper member and a sole member, the sole member including at least an outsole member and a midsole member, the midsole member defining a cavity in a heel portion of the article of footwear, and at least one of the midsole member or the outsole member including one or more apertures in the heel portion of the article of footwear; and a removable heel pad to detachably engage the cavity in the heel portion of the article of footwear, the removable heel pad further including one or more protrusions extending therefrom to detachably engage the one or more apertures, and wherein the removable heel pad includes a strap member extending from the removable heel pad.

2. A footwear system according to claim 1, wherein the one or more apertures include one or more lateral apertures and one or more bottom apertures.

3. A footwear system according to claim 2, wherein the one or more protrusions include one or more lateral protrusions to extend laterally from the removable heel pad to engage the one or more lateral apertures.

4. A footwear system according to claim 3, wherein the one or more lateral protrusions include one or more lateral side protrusions to extend from a lateral side of the removable heel pad and one or more medial side protrusions to extend from a medial side of the removable heel pad.

5. A footwear system according to claim 2, wherein the one or more protrusions include one or more bottom protrusions extending outwardly from a main body of the removable heel pad to engage the one or more bottom apertures of at least one of the outsole member or the midsole member.

6. A footwear system according to claim 1, wherein the strap member further includes a handle portion.

7. A footwear system according to claim 1, wherein the strap member extends from a medial side of the removable heel pad.

8. A footwear system according to claim 1, wherein the strap member extends around a medial side of the removable heel pad.

9. A footwear system according to claim 1, wherein the removable heel pad includes an impact force attenuation element.

10. A footwear system according to claim 9, wherein the impact force attenuation element further includes a fluid-filled bladder.

11. A footwear system according to claim 10, wherein the fluid-filled bladder further includes a second impact force attenuation element within the fluid-filled bladder.

12. A footwear system, comprising:

an article of footwear including an upper member and a sole member, the sole member including at least an outsole member and a midsole member, the midsole member defining a cavity in a heel portion of the article of footwear, and at least one of the midsole member or the outsole member including one or more apertures in the heel portion of the article of footwear, wherein the one or more apertures include one or more lateral apertures and one or more bottom apertures; and a removable heel pad to detachably engage the cavity in the heel portion of the article of footwear, the removable heel pad further including one or more protrusions extending therefrom to detachably engage the one or more apertures, wherein the one or more protrusions include one or more lateral side protrusions that extend from a lateral side of the removable heel pad and one or more medial side protrusions that extend from a medial side of the removable heel pad to engage the one or more lateral apertures, and wherein the one or more medial side protrusions extend a shorter length from a main body of the removable heel pad than the one or more lateral side protrusions.

13. A foot-receiving device system, comprising:

a foot-covering member;

a foot-supporting member engaged with the foot-covering member, the foot-supporting member defining a cavity in a heel portion of the foot-receiving device system and including a plurality of apertures extending laterally from the cavity and through the foot-supporting member; and a removable heel pad including a plurality of protrusions to detachably engage the apertures of the foot-supporting member, wherein the removable heel pad includes a strap member extending from the removable heel pad.

14. A foot-receiving device system according to claim 13, wherein the strap member extends laterally from a medial side of the removable heel pad.

15. A foot-receiving device system according to claim 14, wherein the strap member further includes a handle portion.

16. A foot-receiving device system according to claim 13, wherein the foot-supporting member further includes a plurality of bottom apertures extending downwardly from the cavity and through the foot-supporting member.

17. A foot-receiving device system according to claim 16, wherein the removable heel pad further includes a plurality of bottom protrusions to detachably engage the bottom apertures of the foot-supporting member.

18. A foot-receiving device system according to claim 16, wherein the removable heel pad further includes an impact force attenuation element.

19. A foot-receiving device according to claim 18, wherein the impact force attenuation element further includes a fluid-filled bladder.

20. A foot-receiving device according to claim 19, wherein the fluid-filled bladder further includes a second impact force attenuation element within the fluid-filled bladder.

21. A method of providing a footwear system, comprising:

providing an article of footwear including an upper member and a sole member, the sole member including at least an outsole member and a midsole member, the midsole member formed to include a cavity defined in a heel portion of the article of footwear, and at least one of the midsole member or the outsole member formed to include one or more apertures in the heel portion of the article of footwear; and providing a removable heel pad to detachably engage the cavity in the heel portion of the article of footwear, the removable heel pad further including one or more protrusions to engage the one or more apertures, and wherein the removable heel pad includes a strap member extending from the removable heel pad.

22. A method of providing a footwear system according to claim 21, wherein the one more apertures include one or more lateral apertures and one or more bottom apertures.

23. A method of providing a footwear system according to claim 22, wherein the one or more protrusions include one or more lateral protrusions to detachably engage the one or more lateral apertures and one or more bottom protrusions to detachably engage the one or more bottom apertures.

24. A method of providing a footwear system according to claim 23, wherein the one or more lateral protrusions include one or more medial side protrusions and one or more lateral side protrusions.

25. A method of providing a footwear system, comprising:

providing an article of footwear including an upper member and a sole member, the sole member including at least an outsole member and a midsole member, the midsole member formed to include a cavity defined in a heel portion of the article of footwear, and at least one of the midsole member or the outsole member formed to include one or more apertures in the heel portion of the article of footwear, wherein the one or more apertures include one or more lateral apertures and one or more bottom apertures; and providing a removable heel pad to detachably engage the cavity in the heel portion of the article of footwear, the removable heel pad further including one or more protrusions to engage the one or more apertures, wherein the one or more protrusions include one or more lateral side protrusions and one or more medial side protrusions to detachably engage the one or more lateral apertures, wherein the one or more protrusions include one or more bottom protrusions to detachably engage the one or more bottom apertures, and wherein the one or more medial side protrusions extend a shorter length from a base portion of the removable heel pad than the one or more lateral side protrusions.

* * * * *